US010271386B2

(12) United States Patent
Goetze et al.

(10) Patent No.: US 10,271,386 B2
(45) Date of Patent: Apr. 23, 2019

(54) INDUCTION HOB AND FLEXIBLE SUPPORT FOR AN INDUCTION HOB

(71) Applicant: E.G.O. Elektro-Geraetebau GmbH, Oberderdingen (DE)

(72) Inventors: Christian Goetze, Berlin (DE); Stephane Lomp, Oberderdingen (DE); Michael Rupp, Eppingen (DE); Timo Dalaker, Oberderdingen (DE); Christian Egenter, Bretten (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 419 days.

(21) Appl. No.: 15/094,616

(22) Filed: Apr. 8, 2016

(65) Prior Publication Data

US 2016/0302263 A1 Oct. 13, 2016

(30) Foreign Application Priority Data

Apr. 10, 2015 (EP) ..... 15163139

(51) Int. Cl.
*H05B 6/06* (2006.01)
*H05B 6/12* (2006.01)

(52) U.S. Cl.
CPC ..... *H05B 6/065* (2013.01); *H05B 6/062* (2013.01); *H05B 6/1236* (2013.01); *H05B 6/1281* (2013.01); *H05B 2213/05* (2013.01); *H05B 2213/07* (2013.01)

(58) Field of Classification Search
CPC ..... H05B 6/062; H05B 6/065; H05B 6/1236; H05B 6/1281; H05B 2213/05; H05B 2213/07
USPC ..... 219/58, 447.1, 448.17, 622, 624, 634, 219/647
See application file for complete search history.

(56) References Cited

U.S. PATENT DOCUMENTS 5,491,423 A * 2/1996 Turetta ..... H05B 3/746 219/447.1
6,184,501 B1 2/2001 Zapf
2009/0134149 A1* 5/2009 Keishima ..... H05B 6/062 219/647

FOREIGN PATENT DOCUMENTS

CN 201014595 Y 1/2008
CN 201947486 U 8/2011
DE 102004016631 A1 11/2005
EP 1087641 A2 3/2001
(Continued)

OTHER PUBLICATIONS

U.S. Appl. No. 14/951,182, "Induction Hob And Method For Controlling An Induction Hob", Unpublished (filed Nov. 24, 2015), (Stephane Lomp, Inventor) (E.G.O. Elektro-Geraetebau GmbH , assignee).

(Continued)

*Primary Examiner* — Thien S Tran
(74) *Attorney, Agent, or Firm* — Alston & Bird LLP

(57) ABSTRACT

An induction hob has a hob plate, a plurality of induction heating coils which are arranged below the hob plate, and a plurality of sensor coils which are arranged below the hob plate and above the induction heating coils, and also temperature sensors. The sensor coils and the temperature sensors are arranged on a flexible support and electrical conductors make electrical contact with the sensor coils on the flexible support. The flexible support has a single common connection device for electrical contact to be made.

21 Claims, 7 Drawing Sheets

(56) References Cited

FOREIGN PATENT DOCUMENTS

| | | | | |
|---|---|---|---|---|
| EP | 2312908 A1 | 4/2011 | | |
| EP | 2670211 A3 * | 8/2014 | ..... | H05B 1/0266 |
| EP | 2312908 B1 * | 8/2017 | ..... | H05B 6/062 |

OTHER PUBLICATIONS

German Patent Application No. DE102014224051.4, Unpublished (fling date Nov. 25, 2014) which corresponds to U.S. Appl. No. 14/951,182, "Induction Hob And Method For Controlling An Induction Hob", Unpublished (filed Nov. 24, 2015), (Stephane Lomp, Inventor) (E.G.O. Elektro-Geraetebau GmbH , assignee).

The State Intellectual Property Office of the P.R.C., First Office Action, including search report, for Application No. 201610215336.9, Nov. 5, 2018, 16 pages, China.

* cited by examiner

INDUCTION HOB AND FLEXIBLE SUPPORT FOR AN INDUCTION HOB

CROSS-REFERENCE TO RELATED APPLICATIONS

This application claims priority to European Application No. 15163139.7, filed Apr. 10, 2015, the contents of which are hereby incorporated herein in its entirety by reference.

TECHNOLOGICAL FIELD

The invention relates to an induction hob and also to a flexible support for a plurality of sensor coils for installation into an induction hob below the hob plate of the induction hob.

BACKGROUND

U.S. Ser. No. 14/951,182, which has the application date of Nov. 24, 2015, and was not a prior publication, discloses arranging a plurality of sensor coils in an induction hob below the hob plate of the induction hob and above induction heating coils. In this case, the sensor coils are arranged in accordance with a specific pattern.

EP 2312908 A1 discloses arranging a large number of sensor coils in a layer between the hob plate and induction heating coils in a similar induction hob. In this case, the sensor coils can be applied to a flat support, for example by means of silk-screening methods or screen printing.

BRIEF SUMMARY

The invention is based on the problem of providing an induction hob of the kind mentioned in the introductory part and also a flexible support having sensor coils on it for installation into an induction hob of the kind, it being possible to solve problems in the prior art with the induction hob and flexible support, and it being possible, in particular, to provide simple and cost-effective production which is also suitable for series production.

This problem is solved by an induction hob and also by a flexible support. Advantageous and preferred refinements of the invention are the subject matter of the further claims and will be explained in greater detail in the text which follows. In the process, some of the features will be described only for the induction hob or only for the flexible support. However, irrespective of this, the features are intended to also be able to apply both for the induction hob and also for the flexible support independently. The wording of the claims is incorporated in the description by express reference.

It is provided that the induction hob has a hob plate, at least one induction heating coil which is arranged below the hob plate, advantageously a plurality of induction heating coils, and generally a plurality of sensors or inductive sensors, such as sensor coils for example, which are arranged below the hob plate and above the induction heating coil. Instead of sensor coils, other inductively acting sensors could also be provided and, under certain circumstances, even capacitive sensors, advantageously in order to be able to detect the presence of a pot on the hob plate above the sensors. Particularly advantageously, one temperature sensor or a plurality of temperature sensors can also be provided, wherein a temperature sensor can be arranged preferably close to the sensor coil or directly on the sensor or on the sensor coil.

The sensors or sensor coils are arranged on a flat flexible support according to the invention and electrical conductors make electrical contact with the sensors or sensor coils on the flat flexible support. The flexible support is composed of a flat material or is produced from a flat material of this kind. Any temperature sensors which may be present are likewise arranged on the flexible support and electrical conductors likewise make electrical contact with the temperature sensors on the flexible support. The flexible support has a single common connection device for electrical contact to be made for the sensor coils which are arranged on the flexible support and any temperature sensors which may be present. Therefore, the connection process can be carried out in a quick and reliable manner.

The flexible support according to the invention advantageously has a textile support part which is composed of a textile material, preferably of mechanically stable and temperature-resistant fibres for use in the induction hob. Glass fibres are considered to be advantageous, but other sufficiently temperature-resistant artificial fibres or other fibres such as aramid or Kevlar fibres can also be used as an alternative. The electrical conductors can be applied to the textile support part and fixed on the textile support part. The electrical conductors can be, for example, thin wires, either monofilaments or multi-filaments, which run on one side of the support, advantageously with a blank or conductive surface. It is also possible for the wires to run on both sides of the flexible support or of the textile support part. The electrical conductors can be fixed, for example, firstly by adhesive bonding or secondly by overstitching.

The sensors or sensor coils and possibly temperature sensors are also applied to the support part and fixed there. Owing to a textile support part of this kind, it is possible to be able to avoid expensive and technically complicated conductor foils, which are to be provided with conductors in a complicated manner, or so-called flexible printed circuits. This saves costs. At the same time, a textile support part of this kind can be deformed considerably more flexibly and simply than a conductor foil or flexible printed circuit.

The induction hob advantageously has at least two induction heating coils next to one another below the hob plate, preferably at least four induction heating coils, for example, also six or eight. In this case, all of the induction heating coils can be of the same size and/or of identical design, for example as is known from the abovementioned document U.S. Ser. No. 14/951,182. Approximately rectangular induction heating coils of this kind allow the surface of the induction hob to be largely completely covered without relatively large gaps between the induction heating coils.

In one refinement of the invention, at least two sensor coils can be provided for each induction coil and can be associated with the induction coil, for example, one sensor coil in the centre of the induction heating coil and one sensor coil in the edge region of the induction heating coil, under certain circumstances with slight coverage. Furthermore, at least one temperature sensor can be provided for each induction coil, but advantageously two temperature sensors are also provided. In an advantageous refinement of the invention, one temperature sensor is provided for each sensor coil, wherein a temperature sensor of this kind is arranged just close to the sensor coil. A sensor coil can have, in general, a free region without turns, particularly advantageously in the central region of the free region or in the centre of the free region. A temperature sensor can advantageously be arranged in this free region.

It is possible for a sensor coil and a temperature sensor to form a structural unit together, and in the process in each case have dedicated electrical connections, but with the option of the electrical connections potentially being combined for quicker and easier electrical connection. To this end, the two parts could be injection-moulded, adhesively bonded or encapsulated for integral strength. As an alternative and advantageously, a temperature sensor is arranged on the sensor coil or in the central region of the sensor coil, but not in the form of a structural unit and not mechanically connected to the sensor coil. In this case, the expenditure on assembly is somewhat higher, but standard components can be directly and individually installed.

A sensor coil in the form of an inductive sensor or generally in the form of a sensor can be wound flat with a maximum of two to three layers. This avoids an excessively high structural height for the induction hob overall and an excessively large distance between the induction heating coils and the hob plate. A sensor coil can have between 10 or 20 and 100 or 200 turns, depending on the desired level of sensitivity.

A temperature sensor can be designed in different ways. A standard component of so-called through-hole technology (THT) construction with two connection wires which can be easily connected to the electrical conductors on the flexible support or the textile support part is advantageous. Surface-mounted device (SMD) components are suitable only when mounting and electrical connection to the conductors is possible by means of soldering.

In a refinement of the invention, an additional flat rigid support which bears against the flexible support or textile support part, in particular in order to stabilize the flexible support or textile support part and/or to improve handling and mounting in the induction hob, can be provided. Therefore, this flat rigid support runs between the at least one induction heating coil and the bottom face of the hob plate. In this case, the flat rigid support should be mounted with a spring action in relation to the induction heating coil. The flat rigid support can completely cover the flexible support and/or the sensors or sensor coils which are arranged on the flexible support.

In a refinement of the invention, it is possible to arrange the flat rigid support between the induction heating coils and the flexible support. In this way, it is easier to accurately place or mount the flexible support above the at least one induction heating coil. The one induction heating coil or the plurality of induction heating coils specifically do not have a continuous flat and closed surface, and therefore positioning and/or displacement is often difficult. Furthermore, a uniform height level of the sensors or sensor coils and therefore also a uniform distance from the hob plate can be defined owing to the sensors or sensor coils bearing on the flat rigid support.

In a further refinement of the invention, it is possible for an abovementioned flat rigid support to bear against the bottom face of the hob plate and run above the sensors or sensor coils. Therefore, direct bearing of the sensors or sensor coils against the bottom face of the hob plate can be avoided.

In a further advantageous refinement of the invention, two additional flat rigid supports are provided, the additional flat rigid supports approximately overlapping over their area or covering the flexible support with the sensors and sensor coils which are arranged on it at least on both sides. The two flat rigid supports together with the flexible support between them can even form one structural unit in a manner connected to one another, this structural unit then being very easy to mount.

In one refinement of the invention, the flexible support can have a separate connection support, wherein this separate connection support once again has or forms the abovementioned common connection device. The separate connection support can overlap the flexible support or the textile support part and be fastened on the flexible support or textile support part by way of an end region. Furthermore, the textile support part and, respectively, the electrical conductors which are arranged on the textile support part can make electrical contact with the separate connection support or the separate connection support can be connected to the textile support part or the electrical conductors which are arranged on the textile support part. A separate connection support of this kind can project slightly from the textile support part in the manner of a connection cable. In this case, the connection support can be a component which was originally separate from the textile support part and has been subsequently connected to the textile support part. The connection support can advantageously also be composed of a different flexible material, particularly advantageously can be in the form of a foil support or conductor foil or flexible printed circuit with conductor tracks applied to it in a conventional manner.

Since the common connection device of the flexible support has to be connected to a mating connection of the induction hob during assembly of the induction hob, this usually being performed manually and requiring manual intervention, it is advantageous here to use a more robust and insensitive material than that of the textile support with the electrical conductors applied or stitched to it. It is possible to design the separate connection support to be much smaller than the textile support part, so that less of a more complicated and expensive material like the foil supports or flexible printed circuits is required. In this case, the connection support corresponds substantially to a kind of flat cable with a certain width but a very small thickness. When the textile support part is joined to the connection support, the conductor tracks of the connection support then also have to be connected to the electrical conductors on the textile support part. To this end, contact-connections, in particular in the form of contact fields, can be provided at an end region, which is opposite the end region with the common connection device, in the case of an elongate connection support. The contact-connections can extend over at least one third, preferably at least half, of the length of the connection support. The contact-connections are advantageously arranged in a row so as to run on or close to at least one outer side, advantageously on both outer sides.

The end region with the common connection device can project a few centimeters beyond the textile support part, for example, at most 10 cm to 15 cm. The flexible support preferably has only one single connection support of this kind with a total of one single connection device in the form of, for example, a plug-in connection apparatus which allows quick and easy electrical connection.

When the contact-connections of the separate connection support make electrical contact with the electrical conductors on the textile support part, electrical contact can be established by contact-pressure in the first instance. A mechanical connection can be improved by conductive adhesive or conductive paste. Soldering can also be performed depending on the material and heat resistance of the separate connection support, but soldering is usually not recommended on account of the relatively high temperatures in an induction hob.

One advantageous connection option is when the contact-connections of the separate connection support and the electrical conductors of the textile support part are held together by bent-over contact clips. To this end, a recess or a hole can run through the separate connection support and the textile support part next to the location of the connection of the separate connection support and the electrical conductors, advantageously as close as possible to the contact which is to be established or the connection which is to be established. In this case, a contact clip which has not yet been bent over can then be passed through and then bent over in a U-shape at least to such an extent that the two lateral U-limbs are bent towards one another and, in the process, press together the contact-connection of the separate connection support and the electrical conductor of the textile support part. A connection technique of this kind is known in the automotive sector by the term "splice technology", a kind of crimping technique. If recesses of this kind through the separate connection support and the textile support part are produced next to the connection, which is to be established, on both sides, a clip can be bent over as it were once, this producing an even better connection. A contact clip of this kind can be composed of a relatively thin material, preferably a kind of flat wire. The requisite mechanical forces are not particularly large. Furthermore, fastening which is sufficiently stable overall is produced in the case of a large number of connections of this kind, which are to be established, between the separate connection support and the textile support part.

These and further features can be gathered from the claims as well as from the description and the drawings, wherein the individual features can each be implemented in their own right or in groups in the form of sub-combinations in the case of an embodiment of the invention and in other fields, and may represent advantageous and inherently patentable embodiments for which protection is claimed here. The subdivision of the application into individual sections and sub-headings do not restrict the general validity of the statements made therein.

BRIEF DESCRIPTION OF THE SEVERAL VIEWS OF THE DRAWINGS

Exemplary embodiments of the invention are illustrated in the drawings and will be explained in greater detail in the text which follows. In the drawings.

DETAILED DESCRIPTION

Figure 1:
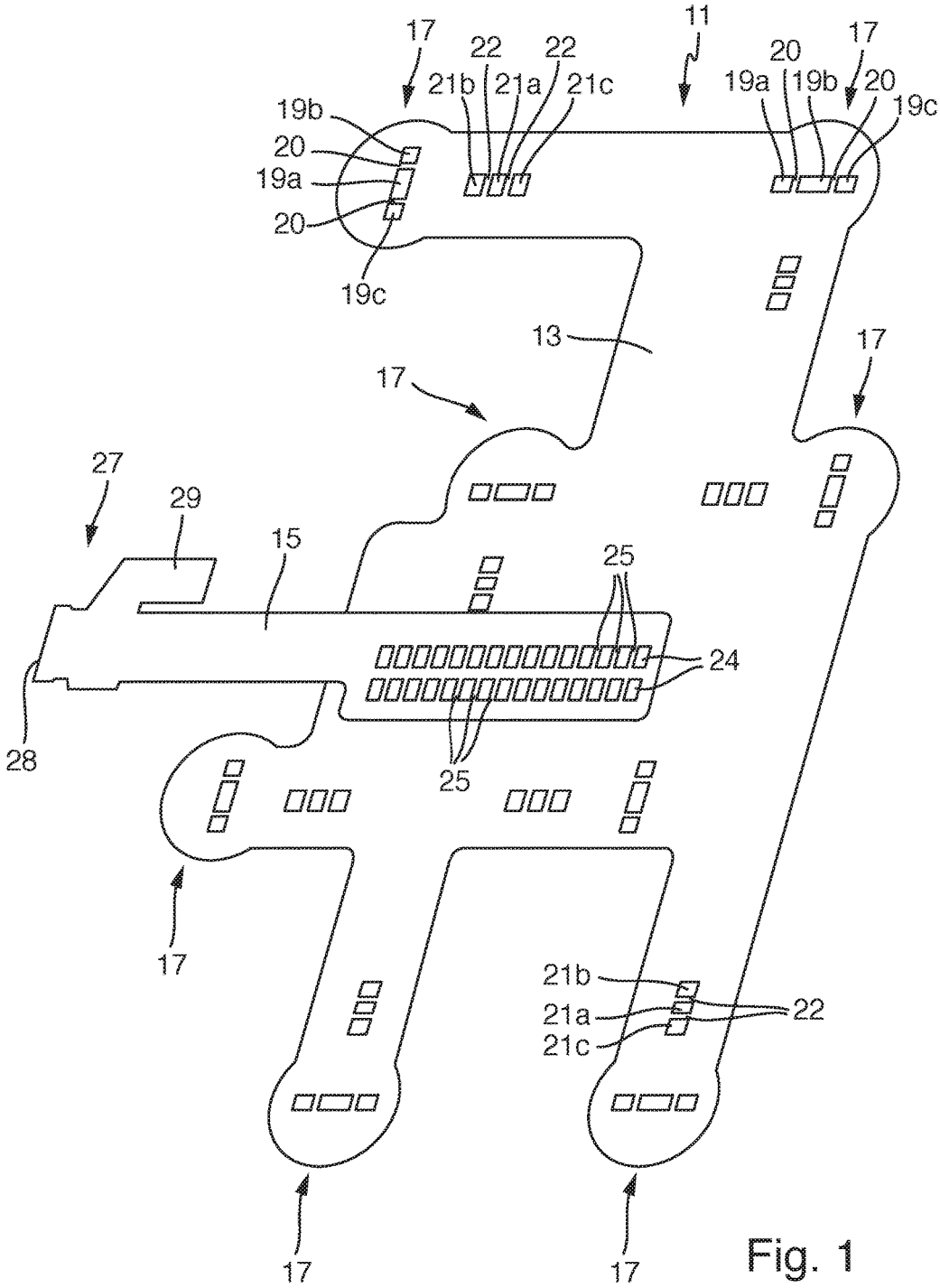
FIG. 1 shows a plan view of a flexible support according to the invention which has a textile support part, which is composed of glass fibre textile, and has a connection support in the form of a flexible printed circuit, together with a large number of recesses.

FIG. 1 illustrates a flat flexible support 11 according to the invention in a very special shape. The shape could also be a substantially rectangular shape, but would then use more material and would, for example, also be heavier. Here, as explained as one option in the introductory part, the flexible support 11 consists of two originally separate parts which are still also composed of different material here. One of the parts is a textile support part 13 which makes up the largest region of the surface and, as will be shown later, is fitted with the sensor coils and temperature sensors. In the illustration in FIG. 1, no conductors have been applied yet. However, recesses 19*a* to 19*c* together with webs 20 situated between them are already provided, for the most part in projecting projection regions 17. As will be explained below, the recesses serve to fasten and make electrical contact with the temperature sensors. Further recesses 21*a* to 21*c* with webs 22 between them are associated with each of the recesses and are situated somewhat at a distance. The further recesses serve to make electrical contact with the sensor coils.

The textile support part 13 is produced from a fibre material, here woven. It is advisable to use appropriate fibres, such as glass fibres for example, for the temperatures of 250° C. to 270° C. which occur when used in an induction hob. The free edges could be lined for this purpose.

A connection support 15 is applied to the textile support part 13 or overlaps the textile support part. The connection support 15 is advantageously in the form of a so-called flexible printed circuit and can be a conductor foil with a large number of conductor tracks, not illustrated here, which are integrally formed on it. In its left-hand-side free end region 27, the connection support 15 has a plug-in connection 28 together with a laterally projecting holding lug 29. In this region, mechanical stabilization or reinforcement can be provided on the connection support, for example by an adhesively-bonded printed circuit board or a plurality of adhesively bonded layers of the same material. The holding lug 29 serves to provide a better grip when manually connecting the plug-in connection 28.

In the right-hand-side end region which overlaps the textile support part 13, the connection support 15 has a large number of recesses 24 in two rows, narrow webs 25 running between the recesses. The recesses serve to fasten the connection support 15 on the textile support part 13 and also to electrically connect the connection support and the textile support part.

Figure 2:
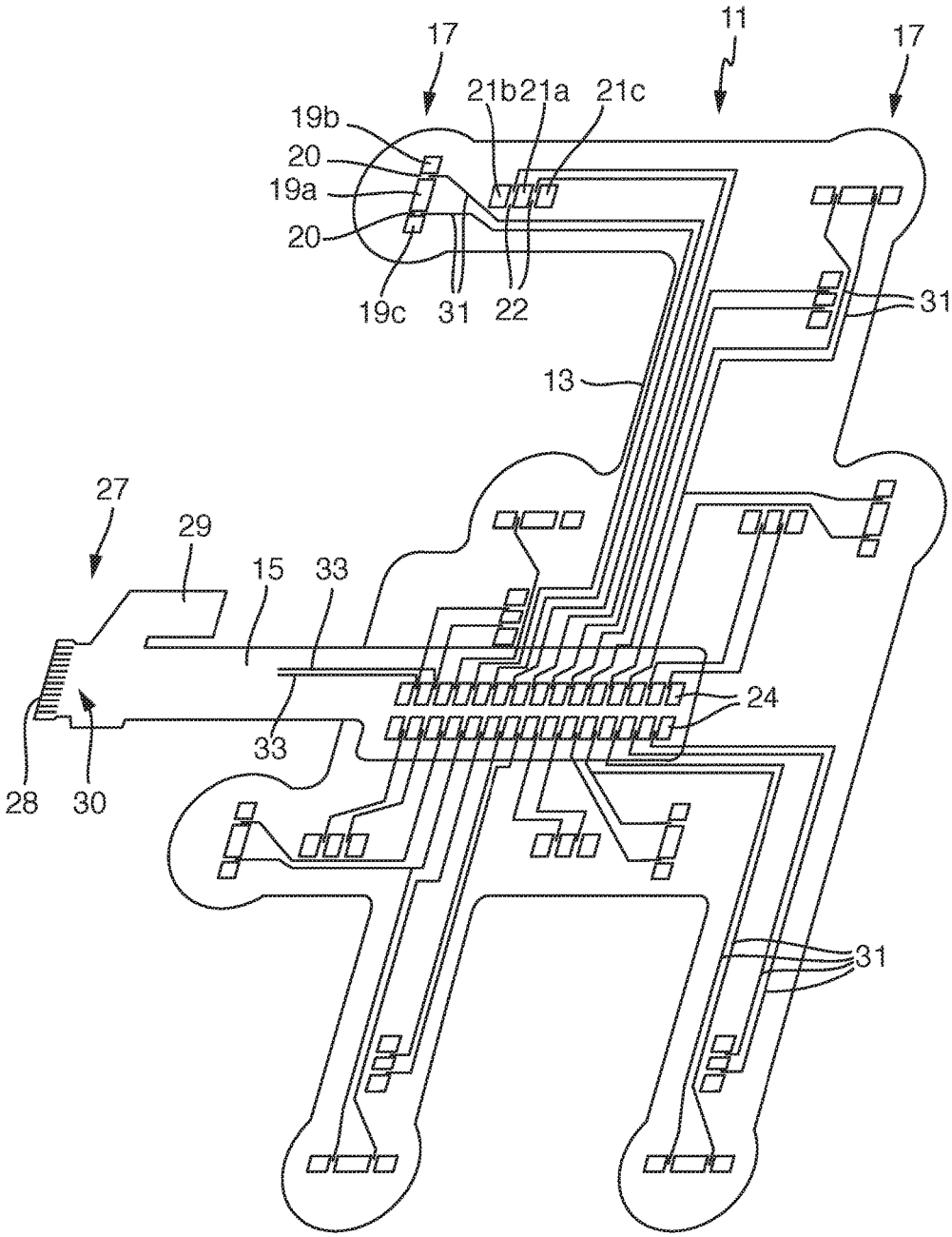
FIG. 2 shows the flexible support from FIG. 1 with a large number of electrical conductors in the form of conductor wires.

In FIG. 2, the flexible support 11 is illustrated in accordance with FIG. 1, but now with electrical conductor wires 31 running on it. As shown in an enlarged illustration in FIG. 4, the electrical conductor wires 31 are fixedly stitched or tacked with a zigzag stitching thread 32 on the textile support part, in each case so as to cross over the conductor wires 31 completely, as is known per se. In this case, the electrical conductor wires are advantageously blank wires, particularly advantageously stranded wires made up of 10 to 30 individual strands.

Conductor wires 31 of this kind run on the textile support part 13 from the webs 20 and, respectively, 22 between recesses 19 and, respectively, 21 to the webs 25 of the recesses 24 in the connection support 15. These recesses 24 and webs 25 are specifically provided in identical form and arrangement precisely thereunder in the textile support part 13 beneath the connection support 15. The connection support 15 has, on its bottom face, blank contact fields, not illustrated here, in a manner associated with the webs 25 of the connection support 15. These contact fields are passed to plug-in connection contacts 30 of the plug-in connection 28 at the free end region 27 by means of conductor tracks 33 on the bottom face of the connection support 15. FIG. 2 shows that each web 25 is reached by a conductor wire 31, and therefore the abovementioned contact fields are present on the bottom face of the connection support 15 in the region of these webs 25.

As is clear from FIG. 2, some of the conductor wires 31 which are passed to the webs 20 between the recesses 19 are brought together. Here, the temperature sensors which can have partially common connections are connected. In the state of the flexible support 11 illustrated here, the connection support 15 is fixedly applied to the textile support part 13. The conductor wires 31 which are stitched onto the textile support part 13 are likewise, as it were, integral constituent parts of the textile support part.

Figure 3:
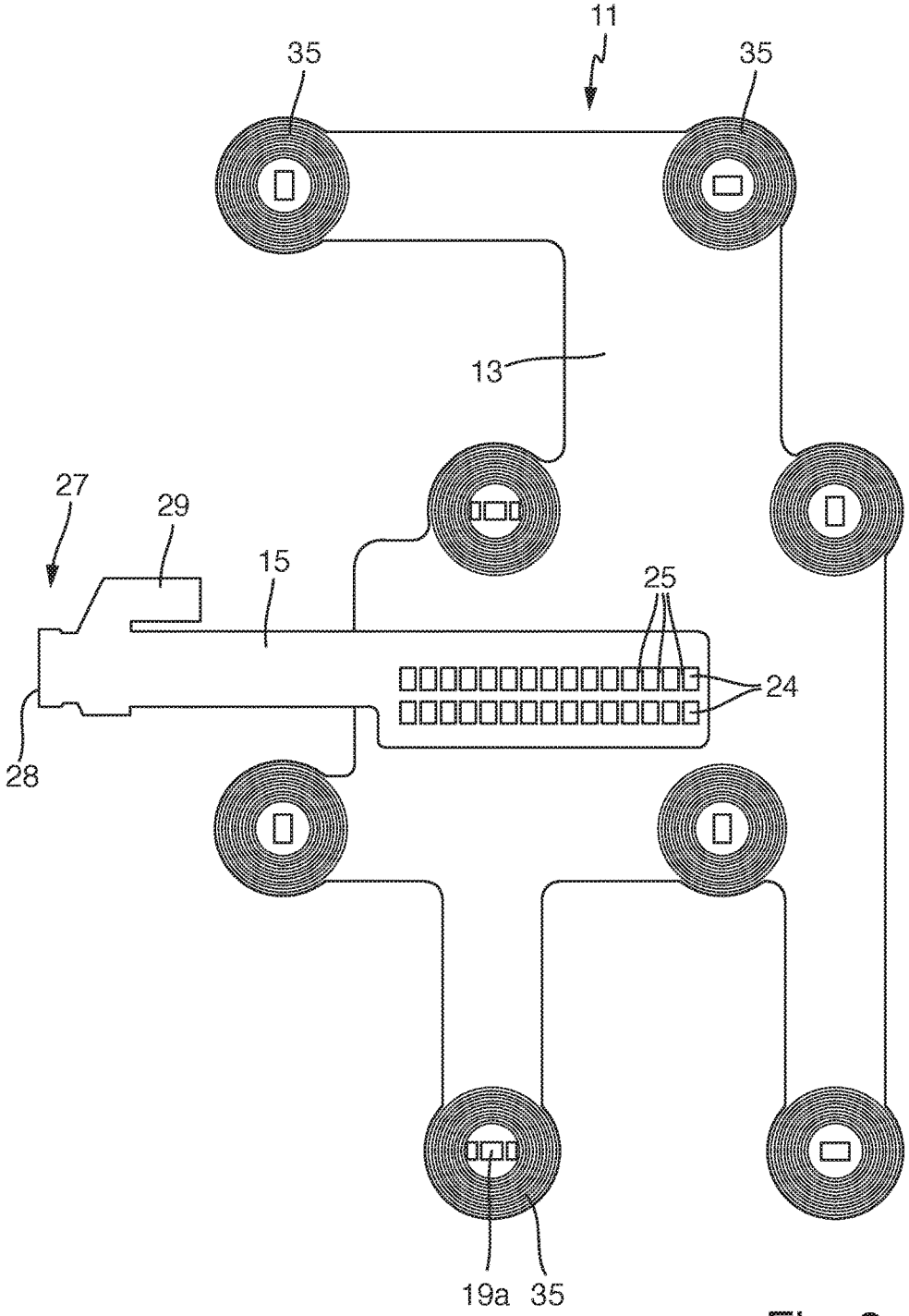
FIG. 3 shows a simplified illustration of the flexible support with inductive sensor coils mounted on the flexible support.

FIG. 3 shows, in a somewhat simplified illustration, how flat sensor coils 35 in the form of inductive sensors for pot identification are placed on the projection regions 17. The flat sensor coils are advantageously fixedly adhesively bonded, for example, by means of temperature-resistant silicone adhesive. The electrical connection of the flat sensor coils will be explained in greater detail below with reference to FIG. 4.

Figure 4:
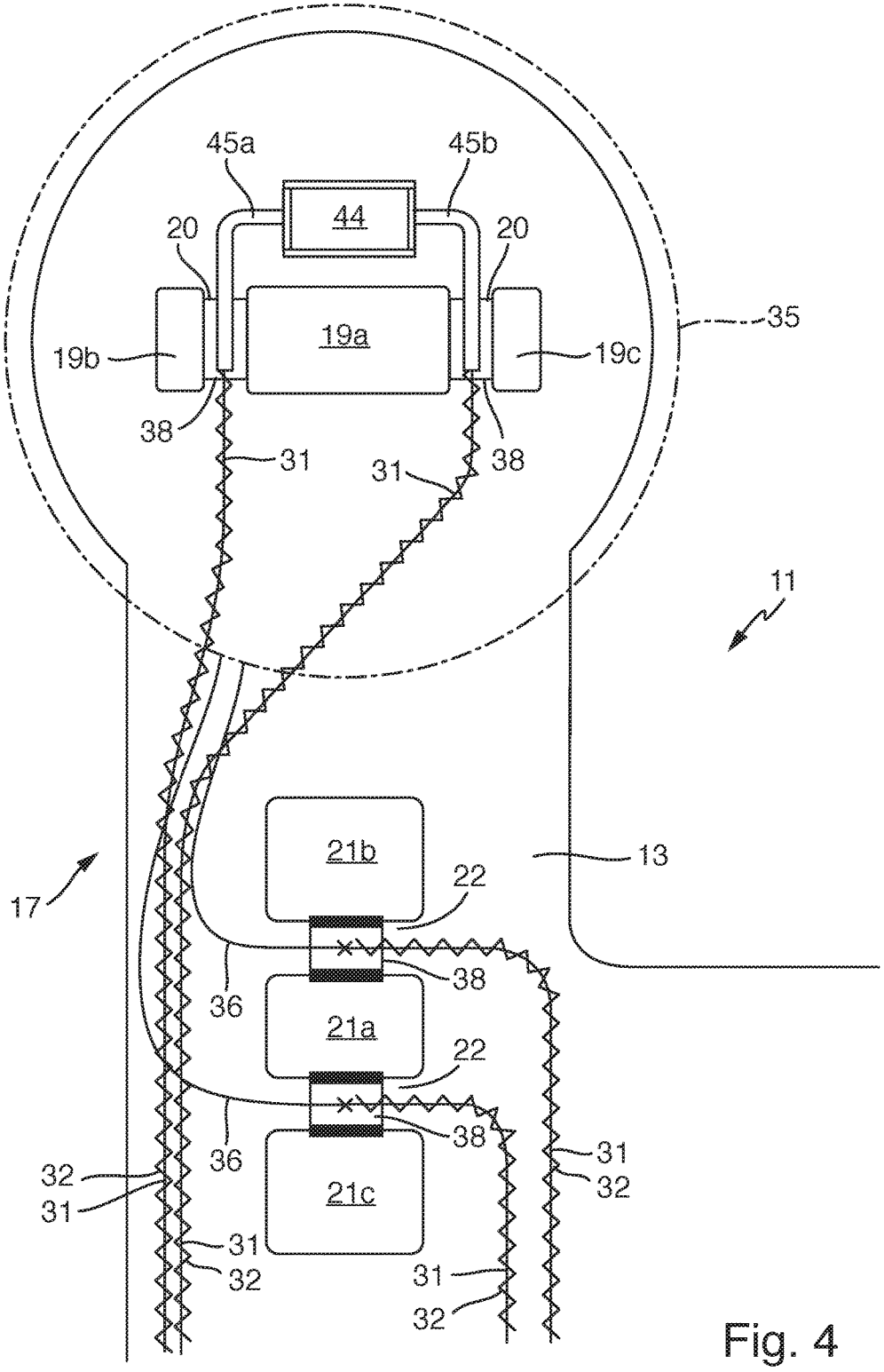
FIG. 4 shows an enlarged view of a projecting projection region of the flexible support with detailed illustrations showing the fastening of the conductor wires to the textile support part, the electrical connection to connections of the sensor coil and of a temperature sensor.

FIG. 4 shows, in a highly enlarged illustration, a projection region 17 of the textile support part 13. Two conductor wires 31 are passed on the left-hand side into the regions of the webs 20 between the recesses 19*a* to 19*c*. In this case, the conductor wires are fixedly stitched on the textile support part 13 by way of the zigzag stitching thread 32 illustrated here. Since the conductor wires 31 are advantageously not insulated, it is necessary to ensure that they are at a certain distance from one another, with displacement being prevented by the stitching thread 32.

The conductor wires 31 lead as far as the webs 20 and, in this case, are fixedly stitched up to shortly in front of the webs. Here, a temperature sensor 44 in the form of an abovementioned THT component is placed onto the textile support part 13. The temperature sensor 44 has two connection wire legs 45*a* and 45*b* which are bent away and likewise lie on the webs 20, where the ends of the two blank conductor wires 31 also lie. Here, they are electrically connected and mechanically fastened.

Two further conductor wires 31 run on the right-hand side on the webs 22 between the recesses 21*a* to 21*c*. The further conductor wires are also fixedly stitched up to the blank ends by a stitching thread 32.

A sensor coil corresponding to FIG. 3 is illustrated only to some extent as a dash-dotted sensor coil 35 here. The sensor coil has two outgoing connection wires 36, the free ends of the outgoing connection wires likewise overlapping the webs 22 between the recesses 21*a* to 21*c*. Since the sensor coils 35, as indicated in FIG. 3, in, for example, two layers consist of 10 to 20 turns which are wound closely to one another, the coil wire has to be electrically insulated or provided with an insulating coating in any case. In this case, the free ends of the connection wires 36 are freed from insulating coating of this kind or are made blank.

Figure 7:
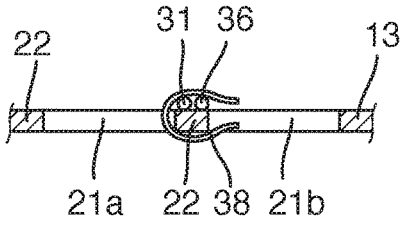
FIG. 7 shows a detailed illustration of a section through an electrical connection of a sensor coil to a conductor wire on the textile support part by means of a clamp which is passed through recesses.

In the enlarged sectional illustration for explaining the connection technique, FIG. 7 shows how both the conductor wire 31 and the connection wire 36 lie on the web 22 between the two recesses 21*a* and 21*b*. A clamp 38 is now passed around this region and compressed, the two recesses 21*a* and 21*b* serving for this purpose. Under certain circumstances, an individual one of these two recesses would also suffice, but both mechanical fastening and electrical contact-connection are advantageously and particularly reliably provided in the illustrated manner. The clamp 38 could also be entirely closed or bent together over the circumference by more than 360°, but this is not necessary. The clamp is advantageously composed of blank metal, such as brass for example, for electrical contact-connection purposes. The material of the clamp is thick and strong enough that the clamp 38 cannot be easily bent open or allowed to deform after it is bent together or clamped together in order to ensure permanent connection. For use in an induction hob, this technique has the advantage that it is highly temperature-resistant, unlike soldering, for example, and primarily the use of electrically conductive adhesives. Furthermore, the technique can be carried out in an automated manner.

The connection of the connection wire legs 45*a* and 45*b* of the temperature sensor 44 to the respective connection wires 31 in the form of an electrical contact-connection and in the form of fastening to the textile support part 13 takes place as illustrated in FIG. 7. In this case, the temperature sensor 44 should lie in a free central region of the sensor coil 35, as is shown in FIG. 3. Therefore, the temperature sensor 44, in addition to the sensor coil 35, can serve to determine both the presence of a pot placed on the hob and also the temperature conditions at a specific point.

Figure 5:
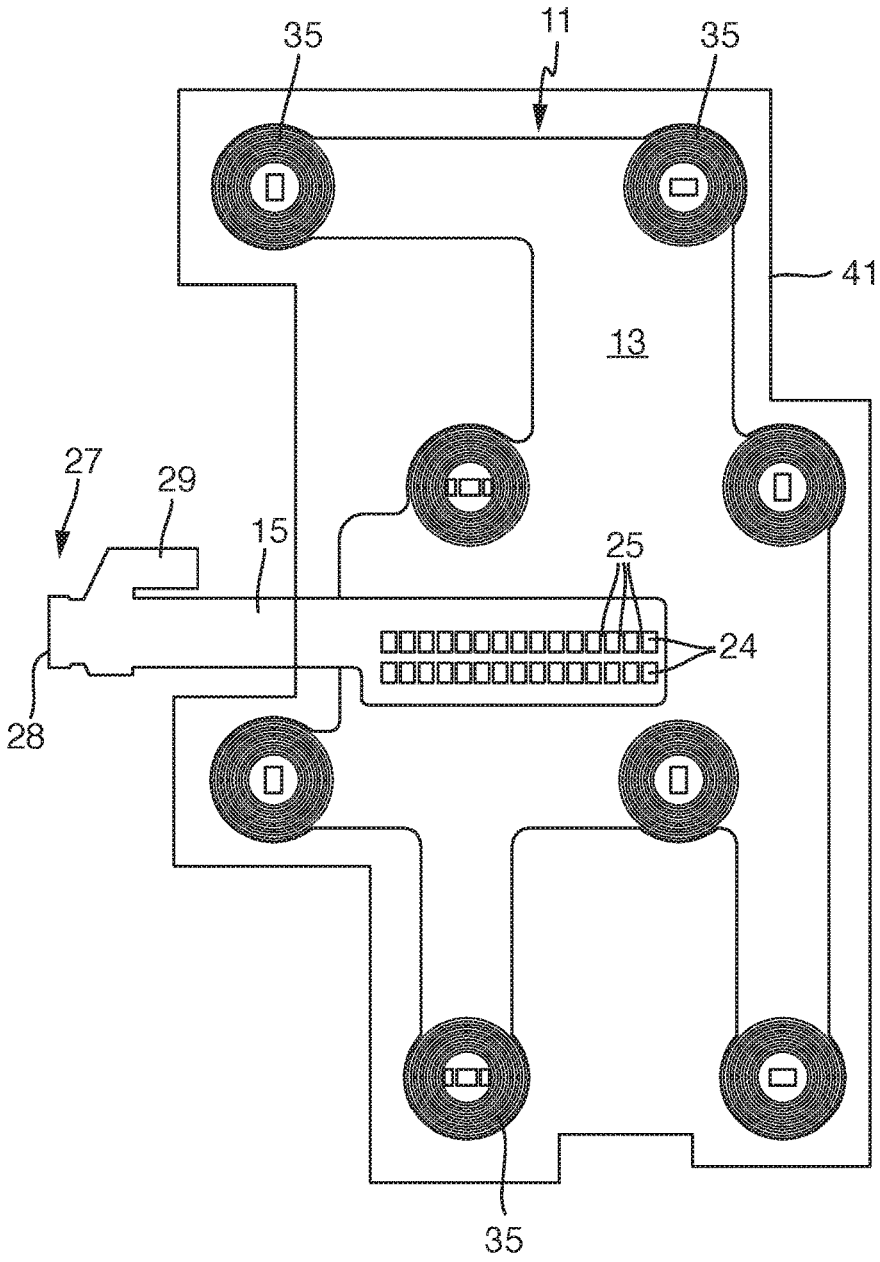
FIG. 5 shows the flexible support from FIG. 3 on a rigid support.

In FIG. 5, the flexible support 11 from FIG. 3 is illustrated on a micanite support 41 in the form of a flat rigid support of the kind mentioned in the introductory part. The flexible support can be placed on or adhesively bonded on the micanite support, for example, adhesively bonded using heat-resistant silicone. A further flat rigid support in the form of a micanite support is placed onto the flexible support, so that a kind of sandwich structure with the two rigid supports on the outside and the flexible support 11 there between is produced. This structural unit 40 is illustrated in section in FIG. 8, the figure showing that the two micanite supports 41 and 42 are pressed together such that the sensor coil 35, illustrated here, rests against the bottom face of the upper micanite support 42. The connection support 15 protrudes out of the structural unit 40 on the left-hand side by way of its free end 27 together with plug-in connection 28.

Figure 6:
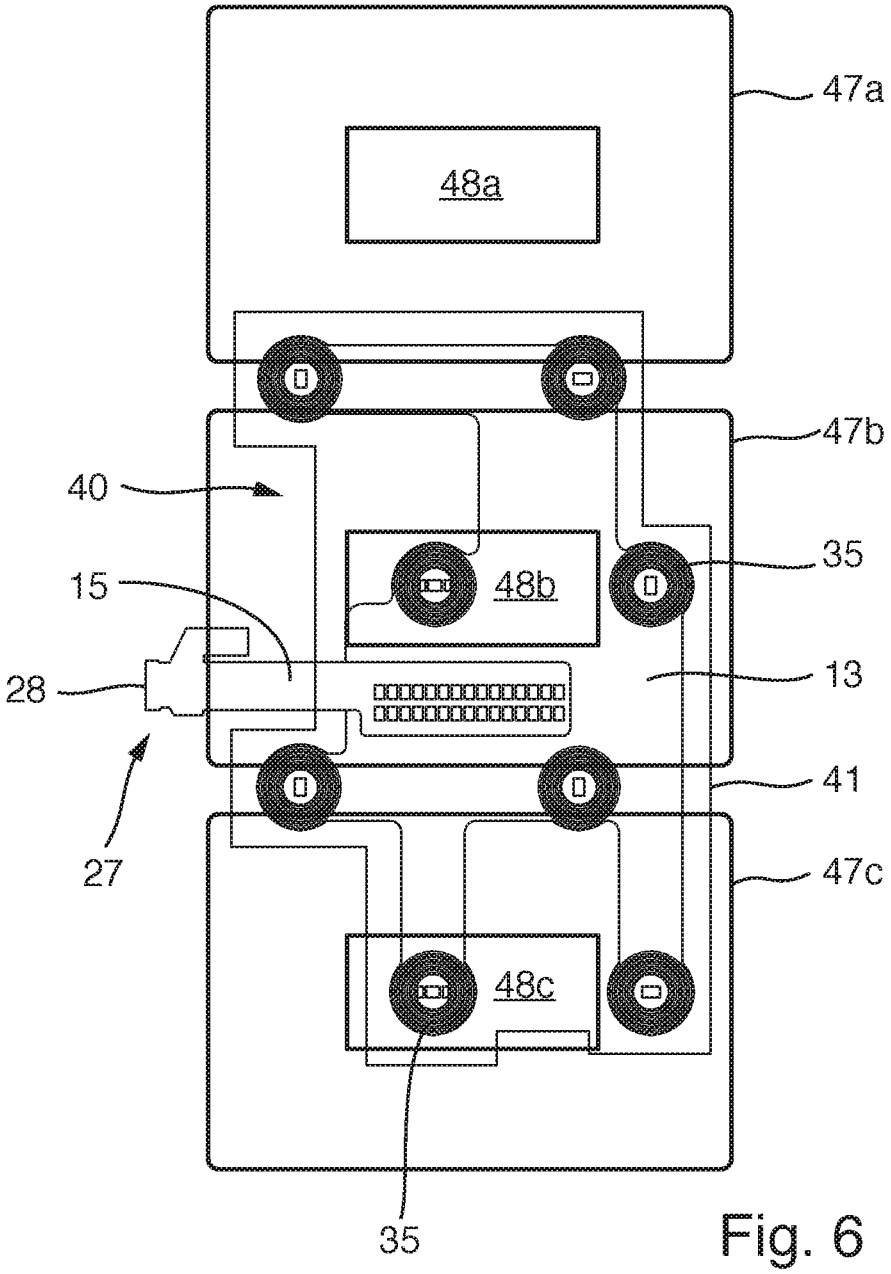
FIG. 6 shows the structural unit from FIG. 5 placed on an arrangement of three induction heating coils.
Figure 8:
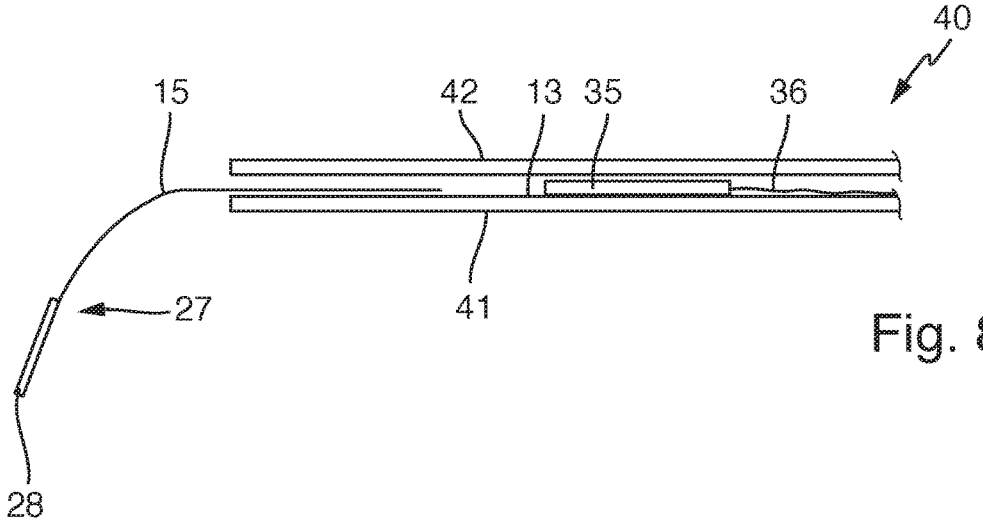
FIG. 8 shows a structural unit similar to FIG. 5 in section with the flexible support together with a sensor coil between two rigid supports.

FIG. 6 illustrates how a structural unit 40 according to FIG. 8 is positioned on induction heating coils. The three induction coils 47*a* to 47*c* illustrated here are of approximately rectangular design in accordance with U.S. Ser. No. 14/951,182 which was mentioned in the introductory part and have a correspondingly approximately rectangular free central region 48*a* to 48*c*. Some of the sensor coils 35 of the structural unit 40 lie with their centre precisely between two induction heating coils 47, the longitudinal sides of the induction heating coils being adjacent, and in each case slightly overlap the induction heating coils, for example, the two topmost sensor coils 35. Two sensor coils 35 lie fully above the free central regions 48*b* and 48*c* of the two lower induction heating coils 47*b* and 47*c*. The two sensor coils 35 on the far right-hand side lie fully above the turns of the induction heating coils 47*b* and 47*c*. This illustration is intended to show that a structural unit 40 can be easily placed onto the induction heating coils 47. In this case, the plug-in connection 28 at the free end region 27 generally protrudes out of the structural unit 40, as is also the case here.

Figure 9:
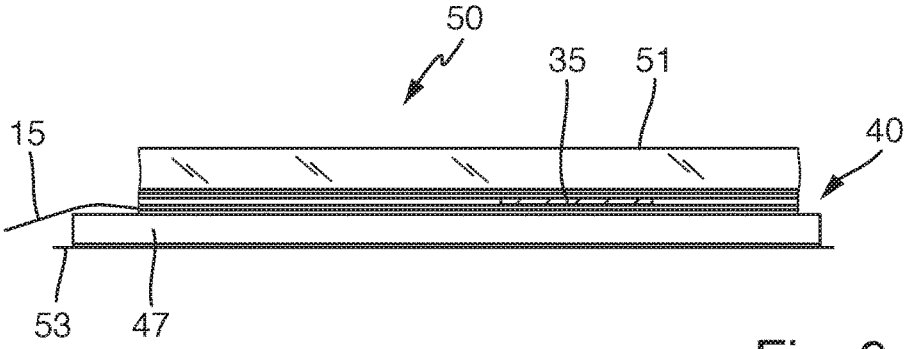
FIG. 9 shows a lateral sectional illustration of an induction hob in the form of a detail with a structural unit corresponding to FIG. 8 which is placed onto an induction heating coil and bears against the bottom face of a hob plate.

A detail of an induction hob 50 according to the invention which has a conventional hob plate 51 is illustrated in FIG. 9. A structural unit 40 corresponding to FIG. 8 is placed onto an induction heating coil 47, advantageously onto a plurality of induction heating coils of this kind. The induction heating coils in turn rest on an inductor support 53, for example, on an aluminum sheet. The hob plate 51 is then placed onto the induction heating coils, so that a sandwich structure is produced. On account of the micanite supports 41 and 42 on both sides of the flexible support 11, the flexible support is protected against damage or interference, for example, by the stitched-on conductor wires 31. It goes without saying that mounting and electrical connection of a structural unit 40 as illustrated can be carried out very easily and reliably and also without damage.

On the basis of FIGS. 1 and 2, it is easily conceivable that a further flexible support according to the invention of a different configuration also has an originally separate connection support which is then fastened on the textile support part, wherein the connection support is also composed of a textile material in this case. Under certain circumstances, the textile support part and the connection support can be produced, as it were, from a single part in the surface projection, so that there are or were not two separate parts. Furthermore, an integral flexible support of this kind could also only consist of a flexible printed circuit or a conductor foil, in which case the large number of recesses together with webs between them would still have to be provided since fastening and electrical contact-connection of components or connection wires by means of soldering causes too many problems at the abovementioned temperatures. This is specifically the advantage of the clip technique or splice technique illustrated in the enlarged illustration in FIG. 7.

Furthermore, instead of the flat sensor coils 35, other inductive sensors could also be used. In a yet further alternative, the sensors could be capacitive sensor elements which can likewise be used for pot identification, as is described, for example, by DE 102004016631 A1 to which reference is made in this respect.

The invention claimed is:

1. An induction hob comprising:

a hob plate;

at least one induction heating coil being arranged below said hob plate; and a plurality of sensor coils being arranged below said hob plate and above said induction heating coil wherein:

a flexible support is provided and said sensor coils are arranged on said flexible support, electrical conductors which make electrical contact with said sensor coils on said flexible support, said flexible support comprises a single common connection device for electrical contact to be made, an additional flat rigid support is provided which runs above said at least one induction heating coil and beneath said hob plate, and said flat rigid support is mounted with a spring action in relation to said induction heating coil and bears against a bottom face of said hob plate.

2. The induction hob according to claim 1, wherein at least two said induction heating coils are arranged next to one another below said hob plate.

3. The induction hob according to claim 2, wherein all of said induction heating coils are of the same size or of identical design.

4. The induction hob according to claim 1, wherein said induction hob comprises at least one temperature sensor which is arranged on said flexible support close to one said sensor coil or on one said sensor coil.

5. The induction hob according to claim 1, wherein at least two said sensor coils or at least one said temperature sensor are provided for each said induction heating coil and are associated with said induction heating coils.

6. The induction hob according to claim 5, wherein one said sensor coil at least partially covers one said induction heating coil.

7. The induction hob according to claim 4, wherein one said temperature sensor is provided for each said sensor coil, wherein said temperature sensor is arranged close to said sensor coil.

8. The induction hob according to claim 7, wherein said sensor coil comprises a free region without turns, wherein in a centre of said free region said temperature sensor is arranged.

9. The induction hob according to claim 1, wherein one said sensor coil is wound flat and is a maximum of two to three layers thick or comprises 20 to 100 turns.

10. The induction hob according to claim 4, wherein said temperature sensor is a component with projecting connection wires as a through-hole technology (THT) component.

11. The induction hob according to claim 1, wherein two said additional flat rigid supports are provided, said additional flat rigid supports overlapping, wherein said flexible support with said sensor coils is arranged between said supports.

12. The induction hob according to claim 1, wherein said flexible support comprises a separate connection support with said common connection device at one end region, which separate connection support overlaps said textile support part and is fastened on said textile support part, and said textile support part and, respectively, said electrical conductors which are arranged on said textile support part make electrical contact with said separate connection support.

13. The induction hob according to claim 12, wherein said connection support is not only a component which was originally separate from said textile support part but rather is also composed of a different flexible material.

14. The induction hob according to claim 13, wherein said connection support is a foil support or conductor foil with conductor tracks formed thereon.

15. The induction hob according to claim 12, wherein said connection support is elongate and comprises a plug-in connection device at one end region as a common connection device.

16. The induction hob according to claim 15, wherein contact-connections to said electrical conductors on said textile support part are provided at another opposite end region, wherein said contact-connections are distributed over at least one third of a length of said connection support.

17. The induction hob according to claim 12, wherein said connection support projects beyond said textile support part by way of said connection device, wherein said flexible support comprises only one single connection support with a total of one single connection device.

18. The induction hob according to claim 1, wherein recesses are provided in said flexible support around the contact on said flexible support or on two opposite sides of said flexible support, said contact clips engaging through said recesses.

19. A flexible support comprising sensor coils on it for installation into an induction hob according to claim 1, wherein said sensor coils are arranged on said flexible support and electrical conductors make electrical contact with said sensor coils on said flexible support, wherein said flexible support comprises a single common connection device for electrical contact to be made.

20. An induction hob comprising:

a hob plate;

at least one induction heating coil being arranged below said hob plate; and a plurality of sensor coils being arranged below said hob plate and above said induction heating coil wherein:

a flexible support is provided and said sensor coils are arranged on said flexible support, electrical conductors which make electrical contact with said sensor coils on said flexible support, said flexible support comprises a single common connection device for electrical contact to be made, said flexible support comprises a textile support part which is composed of a textile material, and said electrical conductors are applied to said textile support part and are fixed, wherein said sensor coils are also applied and fixed to said textile support part.

21. An induction hob comprising:

a hob plate;

at least one induction heating coil being arranged below said hob plate; and a plurality of sensor coils being arranged below said hob plate and above said induction heating coil wherein:

a flexible support is provided and said sensor coils are arranged on said flexible support, electrical conductors which make electrical contact with said sensor coils on said flexible support, said flexible support comprises a single common connection device for electrical contact to be made, at least one of said sensor coils and said at least one temperature sensor on said flexible support are electrically connected by means of bent-over contact clips, and said contact clips press a connection line of said sensor coils or of said temperature sensor onto a connection contact on said flexible support, and wherein, to this end, said contact clips are bent over once over a circumference and are bent together by way of end regions.

* * * * *